US006864632B2

(12) United States Patent
Kao et al.

(10) Patent No.: US 6,864,632 B2
(45) Date of Patent: Mar. 8, 2005

(54) FRONT PLATE STRUCTURE FOR PLASMA DISPLAY PANEL

(75) Inventors: Hsu-Pin Kao, Ping Chen (TW); Hsiang-Hui Tseng, Pateh (TW); Sheng-Wen Hsu, Taipei (TW); Ching-Chung Cheng, Ping Chen (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 213 days.

(21) Appl. No.: 10/315,345

(22) Filed: Dec. 9, 2002

(65) Prior Publication Data

US 2003/0214236 A1 Nov. 20, 2003

(30) Foreign Application Priority Data

May 14, 2002 (TW) ..... 91110065 A

(51) Int. Cl.[7] ..... H01J 17/49; H01J 1/88

(52) U.S. Cl. ..... 313/587; 313/584; 313/292

(58) Field of Search ..... 313/582–587, 313/292, 238, 485, 486, 487, 581; 445/24; 315/169.4; 345/60, 67

(56) References Cited

U.S. PATENT DOCUMENTS

| | | | | | |
|---|---|---|---|---|---|
| 5,661,500 | A | * | 8/1997 | Shinoda et al. | 345/60 |
| 6,008,582 | A | * | 12/1999 | Asano et al. | 313/582 |
| 6,621,231 | B1 | * | 9/2003 | Kwon | 315/169.3 |
| 6,720,732 | B2 | * | 4/2004 | Kao et al. | 313/587 |
| 2002/0003405 | A1 | * | 1/2002 | Kang | 313/586 |
| 2003/0173899 | A1 | * | 9/2003 | Toyoda et al. | 313/583 |

* cited by examiner

*Primary Examiner*—Karabi Guharay
(74) *Attorney, Agent, or Firm*—Harness, Dickey & Pierce, PLC

(57) ABSTRACT

An front plate structure for a plasma display panel is described. In accordance with the present invention, a protruding space pad structure is formed on the dielectric layer or protective layer of the front plate. The space pad is used to form the height difference on the surface of the front plate, about 3 $\mu$m to 15 $\mu$m. The height difference forms gas channels between the front plate and the discharge region to improve the performance of the vacuuming and refilling gas steps.

28 Claims, 11 Drawing Sheets

B-B'section

A-A'section

B-B'section

A-A'section

FRONT PLATE STRUCTURE FOR PLASMA DISPLAY PANEL

FIELD OF THE INVENTION

The present invention relates to a plasma display panel (PDP), and more particularly to a front plate structure for a plasma display panel.

BACKGROUND OF THE INVENTION

Plasma display panels (PDP) can be divided into two types, the direct current (DC) type and the alternating current (AC) type, according to their electrical driving mode. In FIG. 1, which illustrates a conventional AC-type PDP, glass plates 11, 12 undergo several manufacturing steps in which many functional layers are formed thereon and are then combined together by sealing the periphery of the glass plates 11, 12. A mixed gas with a predetermined ratio is then introduced into the discharge units between the glass plates 11, 12.

In FIG. 1, a plurality of parallel transparent electrodes 111 and bus electrodes 112, a dielectric layer 113 and a protective layer 114 are sequentially formed on the glass plate 11, hereinafter referred to as front plate 11. Similarly, a plurality of parallel address electrodes 121, a plurality of parallel barrier ribs 122, a fluorescencer 123 and a dielectric layer 124 are formed on the glass plate 12, hereinafter referred to as back plate 12. One transparent electrode 111 on the front plate 11 and one address electrode 121 on the back plate 12, transparent electrode 111 and address electrode 121 being perpendicularly crossed, compose a discharge unit. When a voltage is applied to a specific discharge unit, gas discharge occurs at the discharge unit between the dielectric layers 113 and 124 to induce emission of a colored visible light from the fluorescencer 123.

FIG. 2 is a schematic, cross-sectional view corresponding to FIG. 1. In a conventional AC-type PDP 10, referring to FIGS. 1 and 2 simultaneously, a plurality of parallel-arranged transparent electrodes 111 are formed on the front plate 11. Each of the transparent electrodes 111 correspondingly has a bus electrode 112 to reduce linear resistance of the transparent electrodes 111. In one discharge unit 13, a three-electrode structure, including an X electrode and an Y electrode of the transparent electrode 111 on the front plate 11 and an address electrode 121 on the back plate 12, is generally employed. When a voltage is applied to the above three electrodes of a specific discharge unit 13 to induce discharge, the mixed gas in the discharge unit 13 emits ultraviolet (UV) rays to light the fluorescencer 123 inside the discharge unit 13. The fluorescencer 123 then emits a visible light, such as a red (R), green (G) or blue (B) light. An image is thus produced by scanning the discharge unit array.

In the conventional AC-type PDP 10, the barrier ribs 122 are arranged in parallel strips on the back plate 12. The address electrode 121 between two adjacent barrier ribs 122 is disposed inside the dielectric layer 124. In the structure, the fluorescencer 123 can only be coated on the sidewalls of the barrier ribs 122 and the top surface of the dielectric layer 124, so that only three planes are utilized. In each discharge unit 13, the fluorescencer 123 is coated on a small surface area, so that a low luminescence efficiency is obtained in the conventional PDP 10.

Since an erroneous discharge may occur in a non-discharge unit 13*a*, illustrated in FIG. 3, of the conventional AC-type PDP 10, the distance d between two adjacent discharge units 13 must be increased to prevent the same.

Although a larger non-discharge unit 13*a* prevents erroneous discharge, discharge units 13 are then relatively contracted, i.e. have a reduced opening ratio, and luminescence efficiency is thus decreased. Conversely, a smaller non-discharge unit 13*a* provides larger discharge units 13, but erroneous discharge then readily occurs, so that neighboring discharge units 13 are affected during operation.

In addition, no isolation is provided between the discharge region A and non-discharge region B and erroneous discharge thus readily occurs in the non-discharge region B. A conventional method for solving the erroneous discharge issue in non-discharge region B is to perform an additional treatment of forming black strips to shade a light produced in the non-discharge region B. The contrast of the conventional PDP 10 is therefore increased, but further manufacture cost is incurred.

To solve the foregoing described problems, a discharge region having sealed latticed structure has been provided as shown in FIG. 4. In accordance with the structure, barrier ribs are used to isolate the discharge region A and the non-discharge region B. The discharge region A is a closed space according to this structure. Therefore, the problem of erroneous discharge occurring in the non-discharge region B is solved. On the other hand, the fluorescencer can be coated on the five planes of each discharge unit, i.e. front, back, left, right and bottom planes, thereby improving luminescence efficiency by increasing the fluorescencer coating area. The vacuuming and refilling gas steps are performed between the discharge region A and non-discharge region B after the front and back glass plates of the PDP are adhered to each other. However, the flat surface of the front plate results in the discharge region being closed. The closed discharge region results in greater difficulties when performing the vacuuming and refilling gas steps. Even if the two steps are finished, the process time of the two steps increases due to the structure.

SUMMARY OF THE INVENTION

According to the above descriptions, the flat surface of the front plate of a conventional PDP may result in the discharge region being closed after the front and back plates are adhered to each other. The closed discharge region results in greater difficulties when performing the vacuuming and refilling gas steps. Therefore, the present invention provides a front plate structure for a plasma display panel (PDP) that can resolve above problems.

It is an object of the present invention to provide a front plate structure. In accordance with the present invention, a protruding space pad is formed on the dielectric layer or protective layer. The space pad is used to form the height difference in the surface of the front plate, about 3 $\mu$m to 15 $\mu$m. The height difference forms gas channels between the front plate and the discharge region to improve the performance of the vacuuming and refilling gas steps.

It is another object of the present invention to provide a space pad structure that constricts energy in the discharge space during gas discharge after the front and back plates are adhered to each other, and this structure is helpful in utilizing gas discharge energy. Furthermore, the structure may inhibit unsuitable discharges in non-discharge regions during gas discharging to prevent erroneous discharge and increase the luminescence efficiency.

In accordance with the first embodiment of the present invention, a protruding space pad structure is formed on the protective layer of the front plate. The layout position of the space pad structure on the front plate is related to the layout position of the barrier ribs arranged in the perpendicular direction (y direction) on the back plate. Therefore, this space pad structure is superimposed on the barrier ribs to form an almost closed state in the perpendicular direction after the front and back plates are adhered to each other. The almost closed state in the perpendicular direction constricts energy in this discharge space as well as gas discharge, and avoids erroneous discharge in the adjacent discharge space; this structure is helpful in utilizing gas discharge energy. On the other hand, this space pad forms a height difference on the surface of the front plate. Therefore, gas channels are formed between the barrier ribs arranged in the horizontal direction and the front plate after the front and back plates are adhered to each other. These gas channels are helpful for the gas purging and refilling process during manufacture of a PDP device.

In accordance with the second embodiment of the present invention, a protruding space pad structure is only formed on the protective layer of the front plate in areas corresponding to the non-discharge region on the back plate. In accordance with this kind of design, this space pad structure not only meets the requirement of gas purging and refilling process, but also does not require the alignment between the space pad structure and the barrier ribs on the back plate. Therefore, this space pad structure of the second embodiment decreases the alignment requirement when the front and back plates are adhered to each other.

On the other hand, in the above two embodiments according to the present invention, the space pad area located in the non-discharge region is enlarged. Therefore, the contact stress is decreased after the front and back plates are adhered to each other to avoid damaging the barrier ribs with a larger contact stress.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Without limiting the spirit and scope of the present invention, the space pad structure in a plasma display panels (PDP) proposed in the present invention is illustrated with one preferred embodiment. Skilled artisans, upon acknowledging the embodiments, can apply the space pad structure of the present invention to any kind of plasma display panels to increase the efficiency of gas purging and refilling processes. In accordance with the present invention, a protruding space pad is formed on the dielectric layer or protective layer. The space pad is used to form the height difference in the surface of the front plate, about 3 $\mu$m to 15 $\mu$m. The height difference forms gas channels between the front plate and the discharge region to improve the performance of the vacuuming and refilling gas steps.

There are two embodiments proposed in this disclosure to illustrate the space pad structure of the present invention. In the first embodiment of the present invention, a protruding space pad structure is formed on the protective layer of the front plate in an area corresponding to the barrier ribs arranged in the perpendicular direction on the back plate. Therefore, this space pad structure is superimposed on the barrier ribs to form an almost closed state in the perpendicular direction after the front and back plates are adhered to each other. The almost closed state in the perpendicular direction constricts energy in this discharge space as well as gas discharge, and avoid erroneous discharge in the adjacent discharge space; this structure is helpful in utilizing gas discharge energy. Furthermore, this space pad forms a height difference on the surface of the front plate. Therefore, gas channels are formed between the barrier ribs arranged in the horizontal direction and the front plate after the front and back plates are adhered to each other. These gas channels are helpful for gas purging and refilling process during manufacture of a PDP device.

In accordance with the second embodiment of the present invention, a protruding space pad structure is only formed on the protective layer of the front plate in an area corresponding to the non-discharge region on the back plate. In accordance with this design, this space pad structure not only meets the requirement of gas purging and refilling processes, but also does not require the alignment between the space pad structure and the barrier ribs on the back plate. Therefore, this space pad structure of the second embodiment decreases the alignment requirement when the front and back plates are adhered to each other. On the other hand, the space pad area located in the non-discharge region is enlarged. Therefore, the contact stress may be decreased after the front and back plates are adhered to each other to avoid damaging the barrier ribs due to the larger contact stress. The application of the present invention is not limited to the following embodiments.

Figure 1:
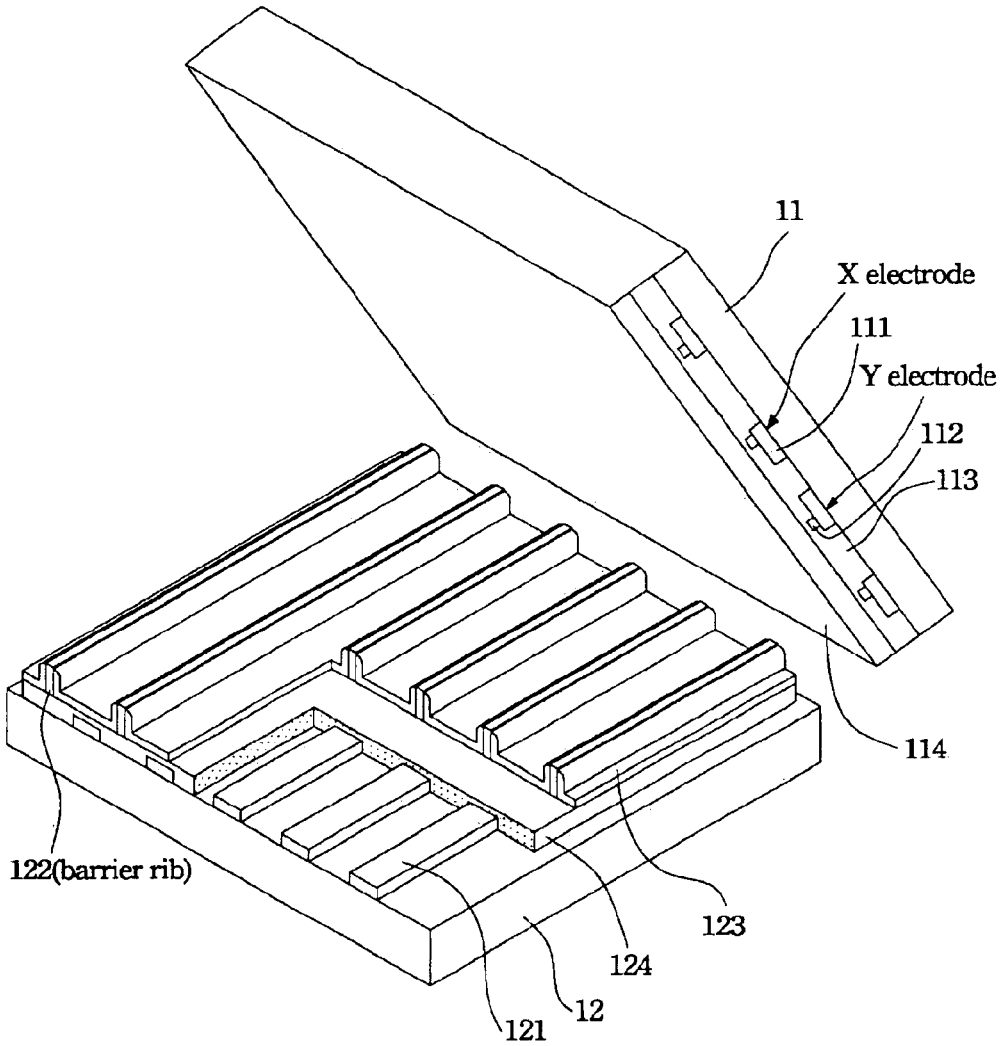
Fig. 1 (PRIOR ART)
FIG. 1 is a schematic assembly diagram of a front plate and a back plate of a conventional plasma display panel.
Figure 2:
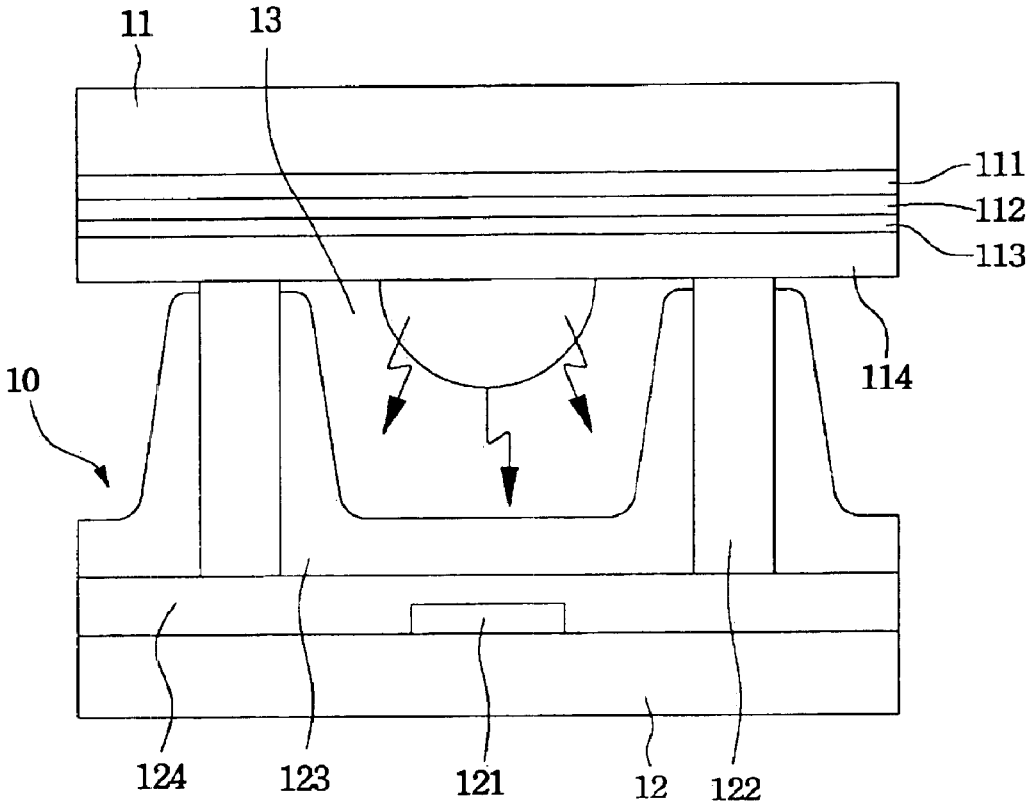
Fig. 2 (PRIOR ART)
FIG. 2 is a schematic, cross-sectional view of a conventional plasma display panel.
Figure 3:
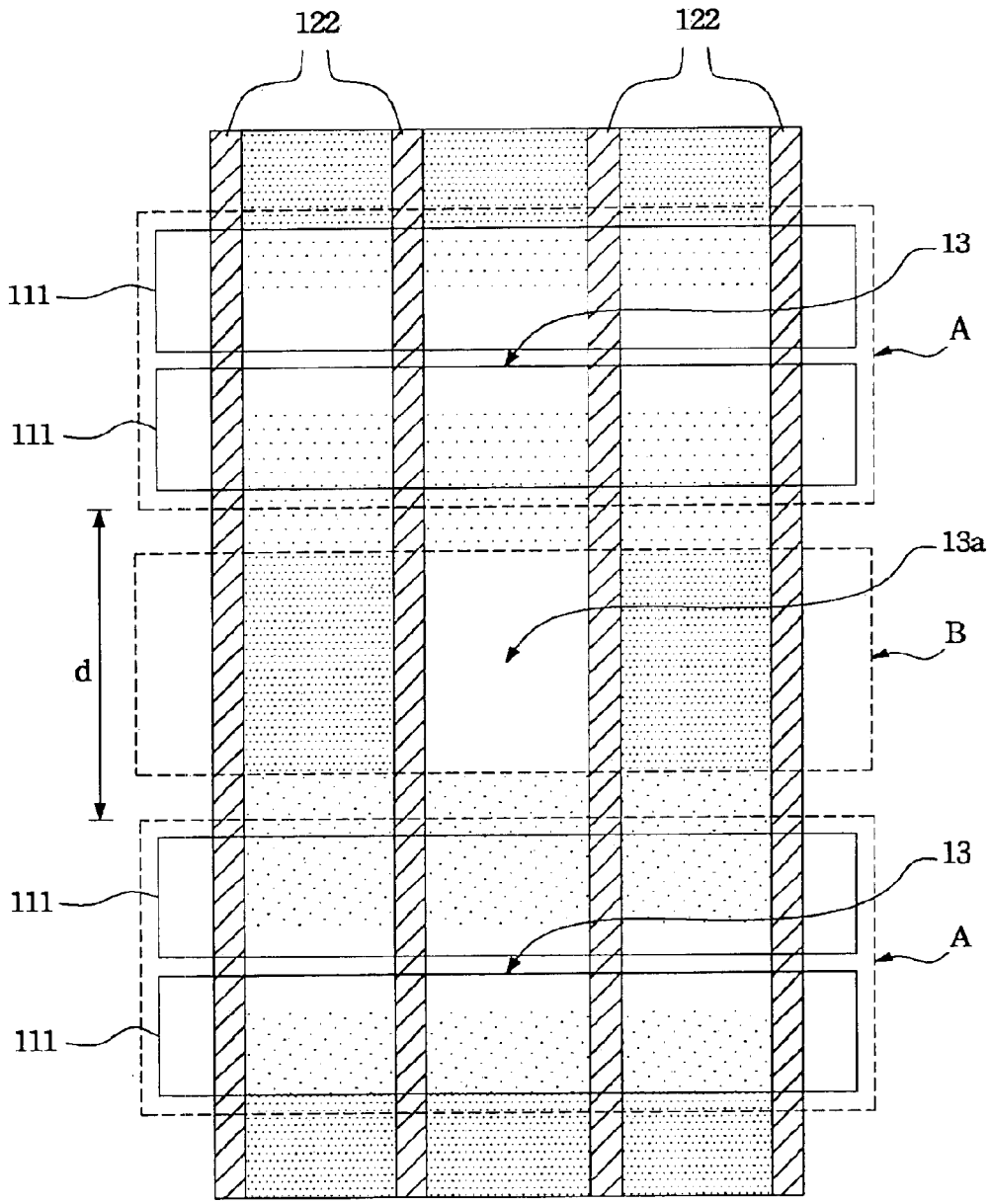
Fig. 3 (PRIOR ART)
FIG. 3 is a schematic top view of a conventional plasma display panel in the state of erroneous discharge in a non-discharge region.
Figure 4:
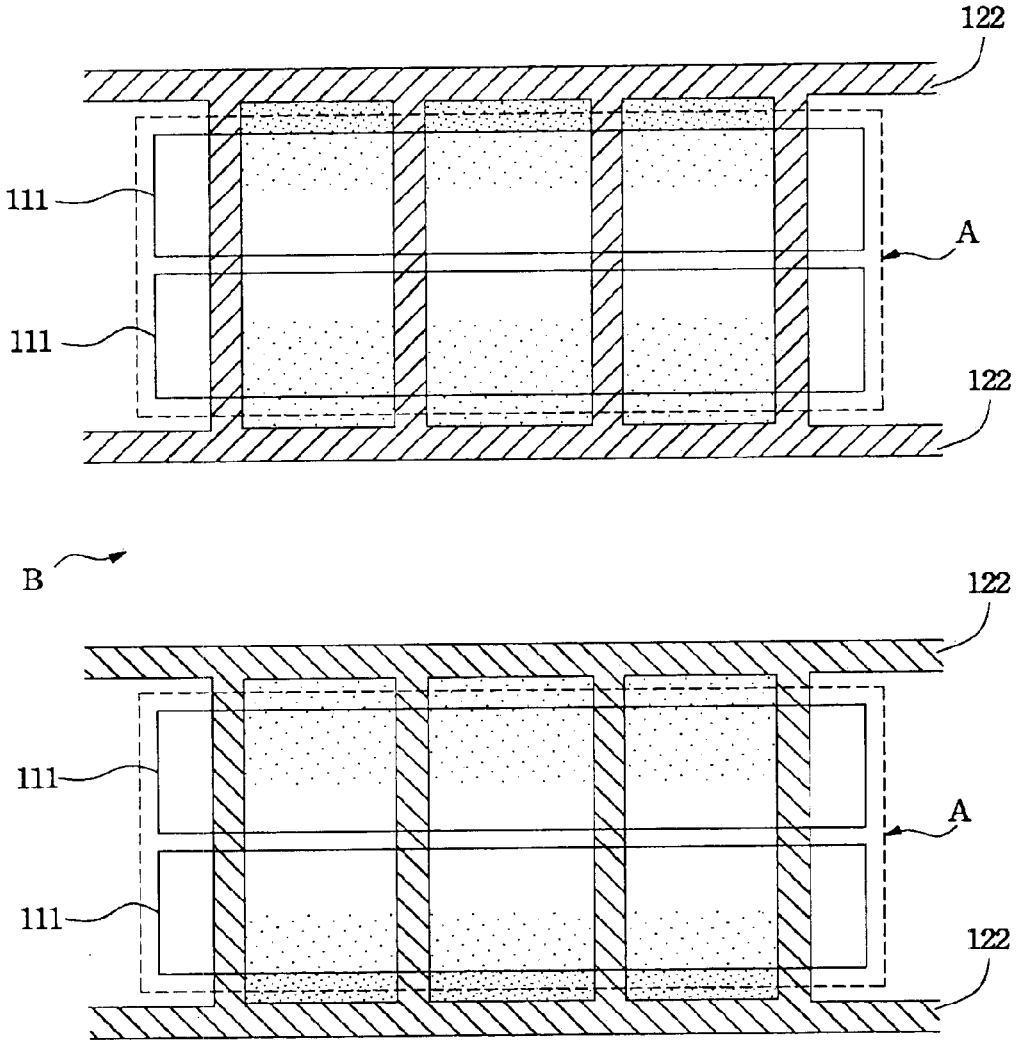
Fig. 4 (PRIOR ART)
FIG. 4 is a schematic top view of a conventional plasma display panel having a waffle structure discharge spaces.
Figure 5:
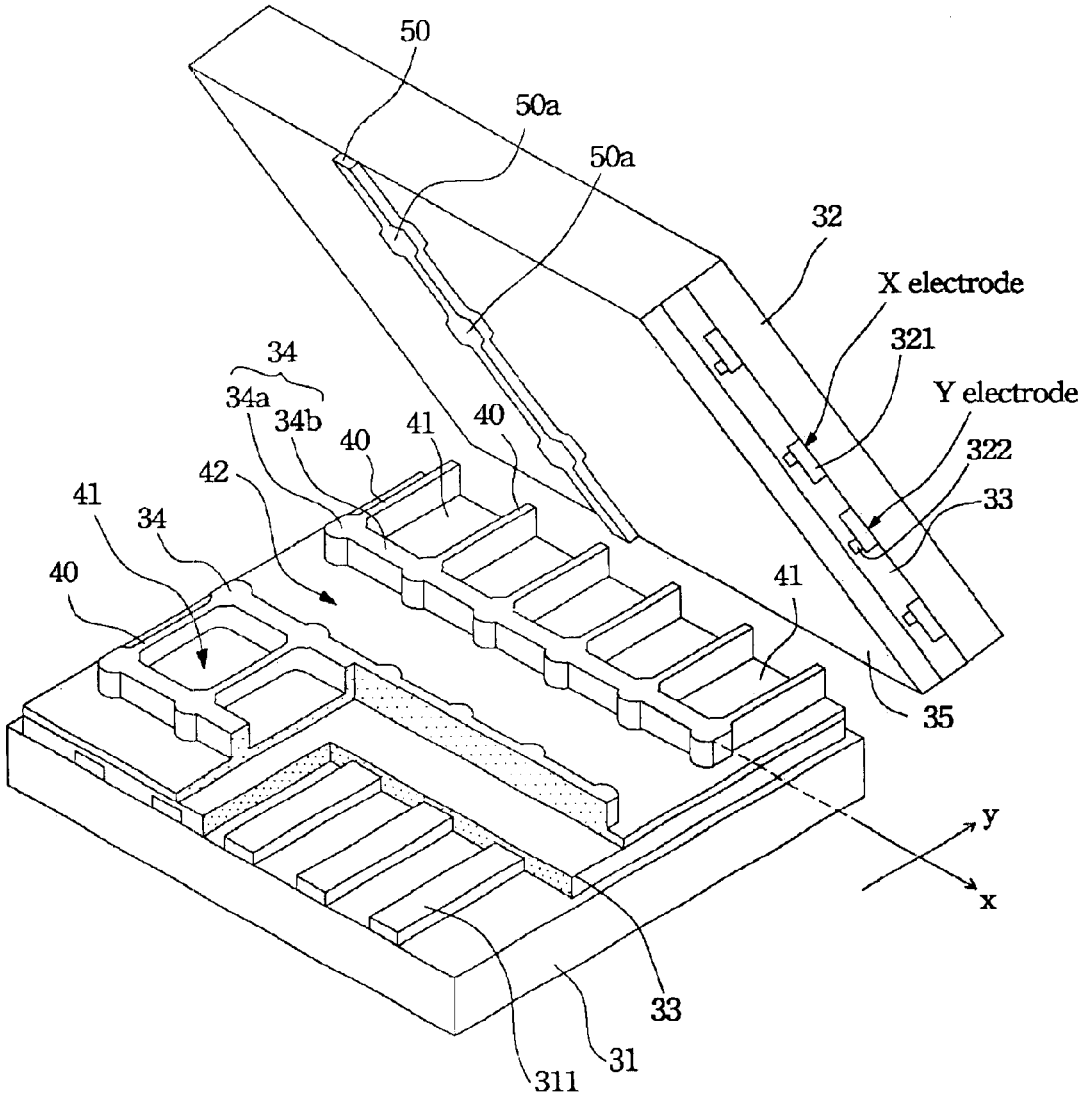
FIG. 5 is a schematic assembly diagram of a space pad structure in a plasma display panel according to the first embodiment of the present invention.

FIG. 5 is a schematic assembly diagram of a space pad structure in a plasma display panel according to the first embodiment of the present invention. The plasma display panel (PDP) of the present invention at least comprises a front plate 32 and a back plate 31. A plurality of address electrodes 311 arranged in a perpendicular direction (y direction as shown in the figure) and parallel to each other are formed on the back plate 31, and a dielectric layer 33 is formed on the back plate 31 to cover the address electrodes 311. A plurality of barrier ribs 34 arranged in a horizontal direction (x direction as shown in the figure) and parallel to each other are formed on the dielectric layer 33. Each barrier rib 34 is designed to form a different width. That is, each barrier rib 34 is formed by a plurality of wide sections 34*a* and narrow sections 34*b* and the wide section and the narrow section are alternatingly formed in the horizontal direction.

On the other hand, a plurality of barrier ribs 40 arranged in perpendicular direction (y direction) are used to connect respectively the wider portion of the adjacent horizontal barrier ribs 34 to form a plurality of discharge spaces 41 having a lattice structure. The corner portions of each discharge space 41 are formed by the wider portion of the barrier ribs 34. The non-discharge region 42 is formed between the adjacent discharge spaces 41 formed by the adjacent horizontal barrier ribs 34. That is, the discharge spaces 41 are adjacent and connected each other in the horizontal direction (x direction). The non-discharge region 42 is used to isolate the discharge spaces 41 in the perpendicular direction (y direction). However, barrier ribs do not exist in the non-discharge region 42 in the horizontal direction (x direction). Therefore, the non-discharge region 42 are used as the gas channels during purging and refilling processes. Furthermore, a plurality of barrier ribs 40 arranged in the perpendicular direction (y direction), which are respectively located between the address electrodes 311, are formed on the dielectric layer 33, so that there is one address electrode 311 between two adjacent barrier ribs 40.

On the inside surface of the front plate 32, a plurality of parallel-arranged transparent electrodes 321, including an X electrode and an Y electrode, is formed. Each transparent electrode 321 has a bus electrode 322 thereon. A dielectric layer 33 is formed on the front plate 32 to cover the transparent electrodes 321 and bus electrodes 322. A protective layer 35 is formed on the dielectric layer 33. A plurality of protruding space pad strips 50 arranged in parallel are formed on the protective layer 35. Each protruding space pad strip 50 is designed to form different width. That is, each protruding space pad strip 50 is composed formed of a plurality of wide portions 50*a* and narrow portions 50*b*. The wide portion 50*a* and the narrow portion 50*b* are alternatingly formed in the perpendicular direction. The layout position of the protruding space pad strips 50 on the front plate 32 is related to the layout position of the barrier ribs 40 arranged in the perpendicular direction (y direction) on the back plate. In other words, these protruding space pad strips 50 is superimposed on the barrier ribs 40 to form an almost closed state in the perpendicular direction (y direction) after the front and back plates are adhered to each other. The wide portion 50*a* is superimposed on the corresponding wide section 34*a* of the barrier ribs 34 of the back plate. Therefore, the contact stress is decreased after the front and back plates are adhered to each other to avoid the barrier ribs damage because of bearing the larger contact stress. In accordance with the first embodiment of the present invention, the configuration of the wide portion 50*a* of the protruding space pad strip 50 is elliptical, but a round or a rectangular configuration is acceptable.

The protruding space pad strips 50 of the present invention are manufactured by using a low dielectric constant material and formed on the protective layer 35. The layout position of the protruding space pad strips 50 on the front plate 32 is related the layout position of the barrier ribs 40 arranged in the perpendicular direction (y direction) on the back plate. In accordance with the preferred embodiment of the present invention, the material used to form the protruding space pad strips 50 is $Al_2O_3$, $TiO_2$ or inorganic ceramics but a material having low reflection rate to improve the contrast is also acceptable. The height of the protruding space pad strips 50 is about 3 $\mu$m to 15 $\mu$m.

When the front plate 32 and back plate 31 are adhered to each other, the protruding space pad strips 50 is superimposed on the barrier ribs 40 to form an almost closed state in the perpendicular direction. In other words, the discharge spaces 41 adjacent to each other in the horizontal direction (x direction) on the back plate 31 are almost closed. That is, the discharge spaces 41 are independent from each other. Therefore, the almost closed discharge space 41 constricts energy therein as well as gas discharge, and avoids erroneous discharge in the adjacent discharge space 41; and this structure is helpful in utilizing gas discharge energy.

On the other hand, with further reference to FIG. 5, the protruding space pad strips 50 are only formed in the perpendicular direction, that is, the flat protective layer 35 is still exposed between the two adjacent protruding space pad strips 50. Therefore, gas channels are formed between the narrow sections 34*b* of the barrier ribs 34 arranged in the horizontal direction and on the front plate 31 after the front and back plates are adhered to each other. These gas channels are helpful for gas purging and refilling process during manufacture of a PDP device.

Figure 6:
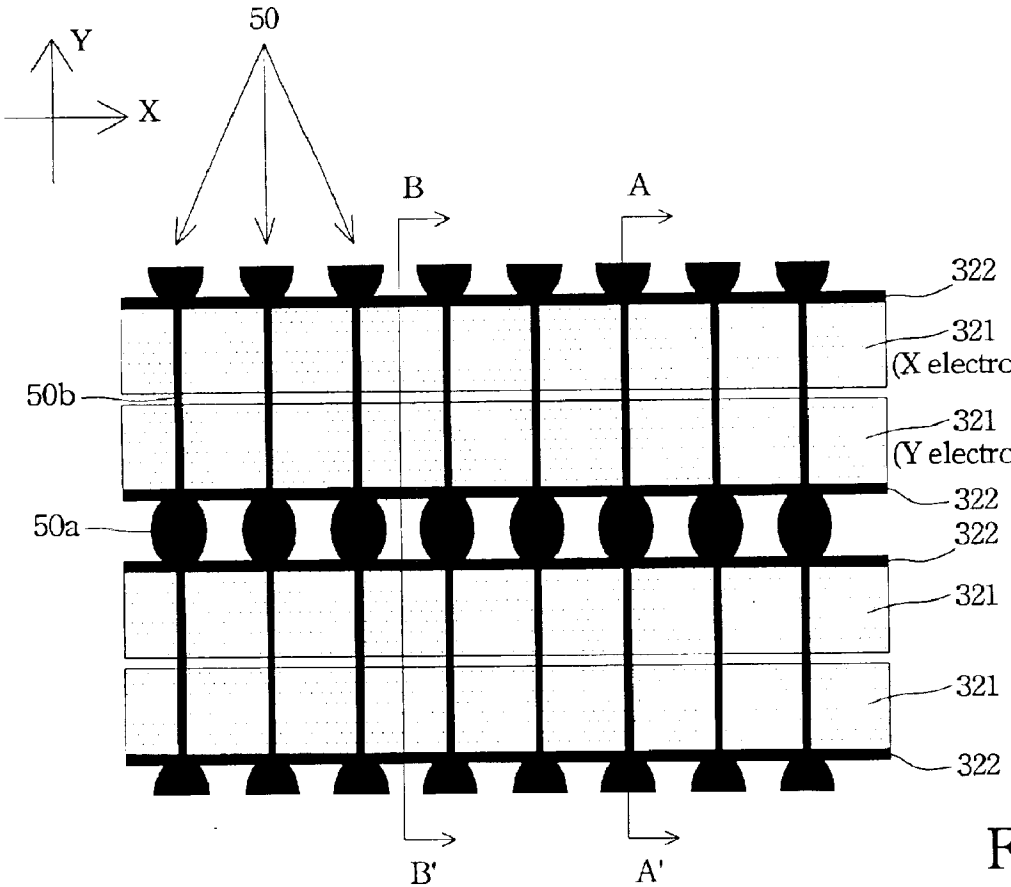
FIG. 6 is a schematic top view of a space pad structure on a front plate according to the first embodiment of the present invention.

FIG. 6 shows a schematic top view of a space pad structure on a front plate according to the first embodiment of the present invention, wherein a plurality of parallel-arranged transparent electrodes 321, including an X electrode and an Y electrode, is formed on the front plate 32. Each transparent electrode 321 has a bus electrode 322 thereon. A plurality of space pad strips 50 according to the present invention are perpendicular to transparent electrodes 321. The height of the protruding space pad strips 50 is about 3 $\mu$m to 15 $\mu$m. The adjacent space pad strips 50 are all separated by special distance. The special distance is equal to the width of the discharge space 41 on the back plate 31. Each protruding space pad strip 50 is designed to form a different width. That is, each protruding space pad strip 50 is formed of a plurality of wide portions 50*a* and narrow portions 50*b*. The wide portion 50*a* and the narrow portion 50*b* are alternatingly formed in the perpendicular direction. The wide portion 50*a* is superimposed on the corresponding wide section 34*a* of the barrier rib 34 of the back plate and across the non-discharge region 42 is superimposed another wide section 34*a* of the adjacent barrier rib 34. Therefore, the contact stress is decreased after the front and back plates are adhered to each other. This avoids damaging the barrier ribs damage with a larger contact stress.

Figure 7B:
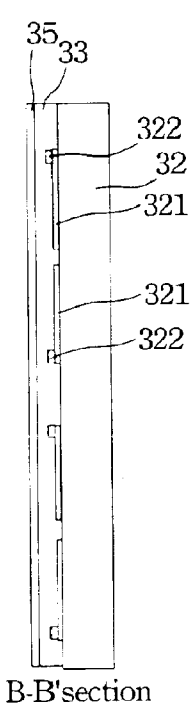
FIG. 7*b* is a schematic, cross-sectional view from the BB' plane shown in the FIG. 6 according to the first embodiment of the present invention.
Figure 7A:
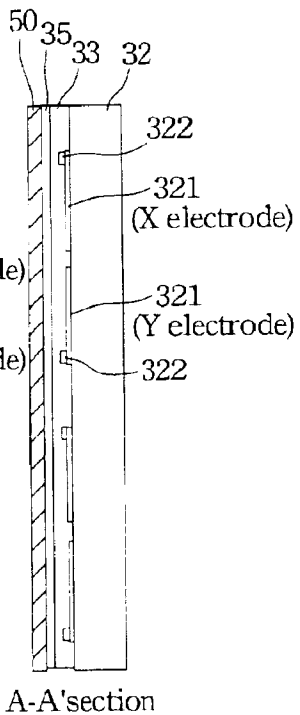
FIG. 7*a* is a schematic, cross-sectional view from the AA' plane shown in the FIG. 6 according to the first embodiment of the present invention.

FIG. 7*a* and FIG. 7*b* respectively show the schematic, cross-sectional views from the AA' plane and BB' plane shown in FIG. 6 according to the first embodiment of the present invention. First, referring to FIG. 7*a,* a plurality of parallel-arranged transparent electrodes 321, including an X electrode and an Y electrode, is formed on the front plate 32. Each transparent electrode 321 has a bus electrode 322 thereon. A dielectric layer 33 is formed on the front plate 32 to cover the transparent electrodes 321 and bus electrodes 322. A protective layer 35 is formed on the dielectric layer 33. A plurality of protruding space pad strips 50 arranged in parallel are formed on the protective layer 35. Similarly, with reference to FIG. 7*b,* because there is no space pad strips 50 on the protective layer 35 in the BB' plane, the space pad strips 50 are not shown in this figure.

Figure 8:
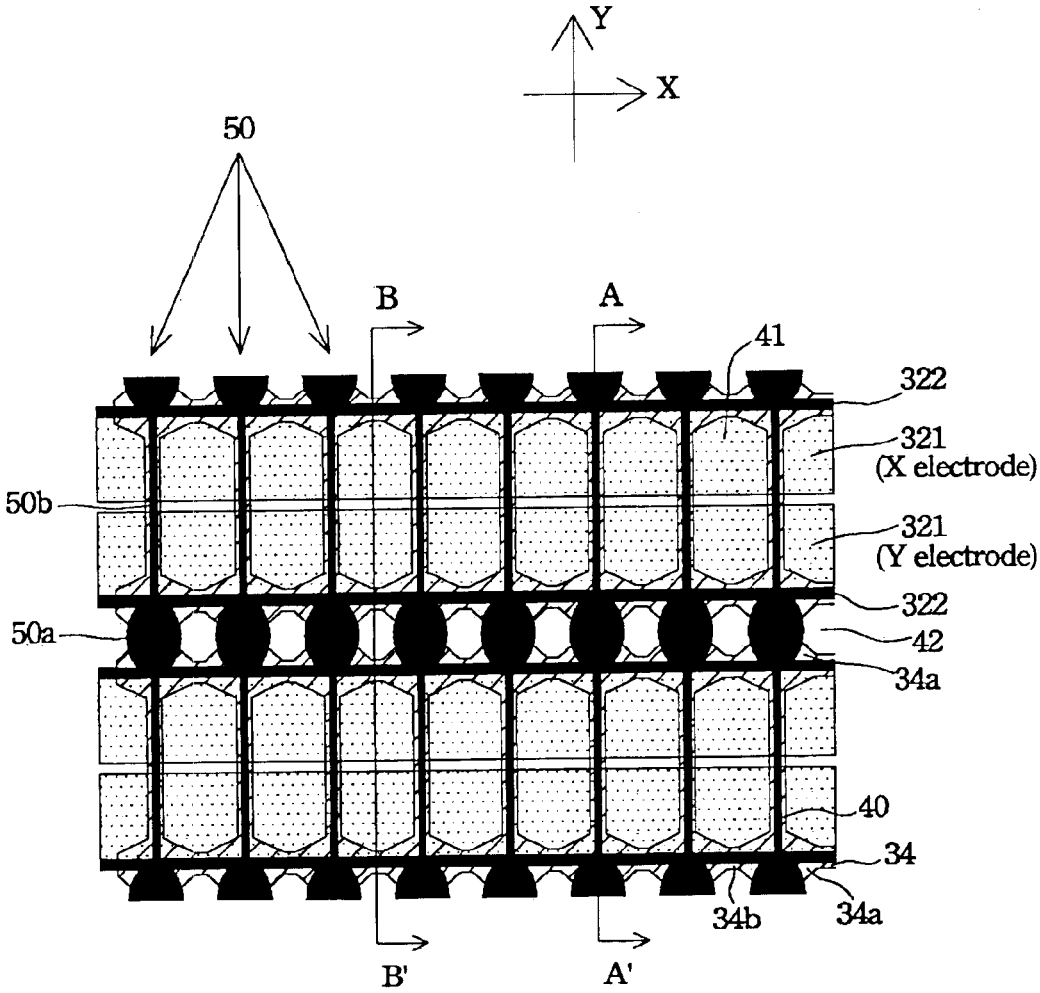
FIG. 8 is a schematic top view after the front and back plates are adhered to each other according to the first embodiment of the present invention.

FIG. 8 shows a schematic top view after the front and back plates are adhered to each other according to the first embodiment of the present invention. A plurality of parallel-arranged transparent electrodes 321, including an X electrode and an Y electrode, is formed on the front plate 32. The non-discharge region 42 is arranged between the adjacent discharge spaces 41. The structure of each barrier rib 34 on the back plate 31 is composed of different widths, wide section 34*a* and narrow section 34*b*. A plurality of barrier ribs 40 arranged in the perpendicular direction (y direction) are used to connect with the wide section 34*a* to divide any adjacent horizontal barrier ribs 34 into a plurality of discharge spaces 41.

With further reference to FIG. 8, the protruding space pad strips 50 having different widths, wide portion 50*a* and narrow portion 50*b,* are formed by using a low dielectric constant material, such as $Al_2O_3$, $TiO_2$ or inorganic ceramics. The layout position of the protruding space pad strips 50 is related the layout position of the barrier ribs 40 arranged in the perpendicular direction (y direction). The wide portion 50*a* is superimposed on the corresponding wide section 34*a* of the barrier rib 34 and across the non-discharge region 42 to superimpose the another wide section 34*a* of the adjacent barrier rib 34. Therefore, the contact stress may be decreased after the front and back plates are adhered to each other to avoid damaging the barrier ribs damage with the larger contact stress.

Figure 9B:
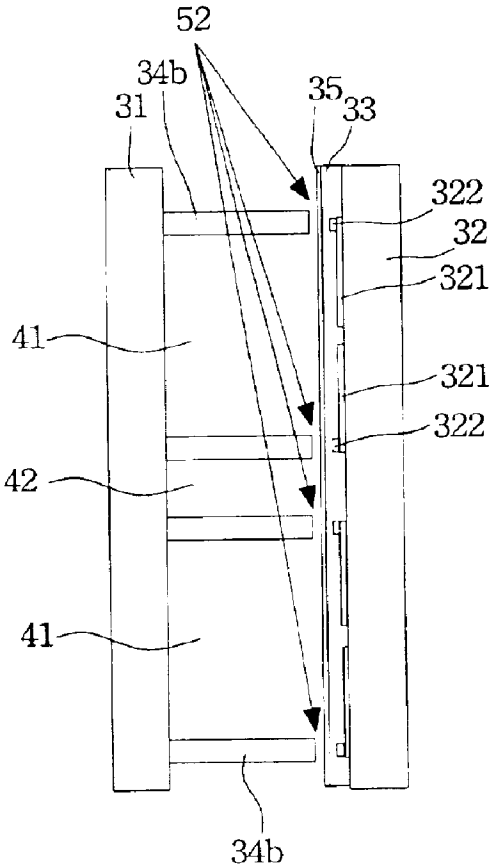
FIG. 9*b* is a schematic, cross-sectional view from the BB' plane shown in the FIG. 8 according to the first embodiment of the present invention.
Figure 9A:
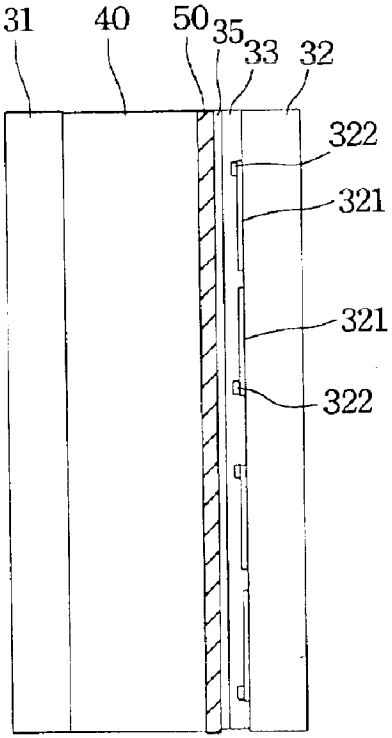
FIG. 9*a* is a schematic, cross-sectional view from the AA' plane shown in the FIG. 8 according to the first embodiment of the present invention.

FIG. 9*a* and FIG. 9*b* respectively show the schematic, cross-sectional views from the AA' plane and BB' plane shown in FIG. 8 according to the first embodiment of the present invention. First, referring to FIG. 9*a,* a plurality of parallel-arranged transparent electrodes 321, including an X electrode and an Y electrode, is formed on the front plate 32. Each transparent electrode 321 has a bus electrode 322 thereon. A dielectric layer 33 is formed on the front plate 32 to cover the transparent electrodes 321 and bus electrodes 322. A protective layer 35 is formed on the dielectric layer 33. A plurality of protruding space pad strips 50 arranged in parallel is formed on the protective layer 35. The barrier ribs 40 arranged perpendicular to the transparent electrodes 321 are formed on the back plate 31. Because of the space pad strips 50 formed on the front plate 32, a closed state is formed in the AA' plane after the front plate 32 and back plate 31 are adhered to each other. That is, the adjacent discharge spaces 41 are independent from each other. Therefore, the almost closed discharge space 41 constricts energy therein as well as gas discharge, and avoids erroneous discharge in the adjacent discharge space 41.

FIG. 9*b* shows the schematic, cross-sectional view from the BB' plane shown in FIG. 8 according to the first embodiment of the present invention. Because there is no space pad strips 50 formed on the front plate 32 in the BB' plane, a flat protective layer 35 is exposed in the BB' plane. Some gas channels 52 are formed between the narrow sections 34*b* of the barrier ribs 34 and the front plate 32 after the front and back plates are adhered to each other. In other words, the discharge spaces 41 in the BB' plane are not closed; they may respectively join the non-discharge region 42 through the gas channels 52. Therefore, it is helpful for gas purging and refilling processes. On the other hand, in accordance with the design of the present invention, the non-discharge region 42 is used to separate the discharge region 41 in the BB' plane. Therefore, it is efficient to avoid the erroneous discharge in the adjacent discharge space 41.

Figure 10:
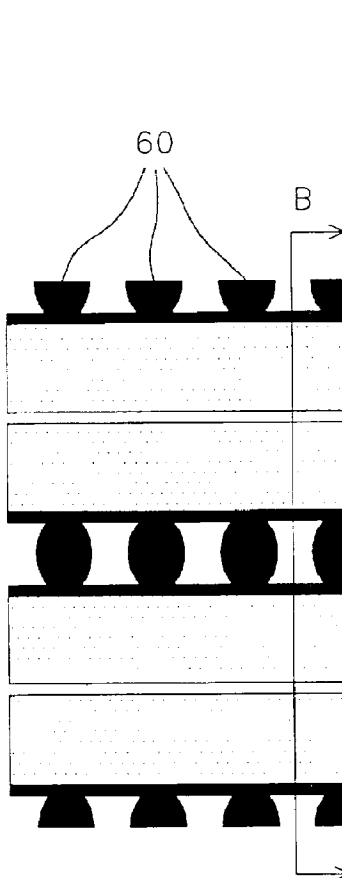
FIG. 10 is a schematic top view of a space pad structure on a front plate according to the second embodiment of the present invention.

FIG. 10, it shows a schematic top view of a space pad structure on a front plate according to the second embodiment of the present invention, in which a plurality of parallel-arranged transparent electrodes 321, including an X electrode and an Y electrode, is formed on the front plate 32. Each transparent electrode 321 has a bus electrode 322 thereon. A plurality of protruding space pads 60 according to the second embodiment of the present invention is respectively arranged between the two adjacent transparent electrodes 321 in areas corresponding to the non-discharge region on the back plate. The adjacent space pads 60 are all separated by special distance in the horizontal direction (x direction). The special distance is equal to the width (x direction) of the discharge space on the back plate. The adjacent space pads 60 are also separated by special distance in the perpendicular direction (y direction). The special distance is equal to the width of the transparent electrodes 321 on the front plate. In other words, the space pads 60 are arranged in an array. The transparent electrodes 321, including an X electrode and an Y electrode, and the space pads 60 are alternatingly formed on the front plate 32.

In accordance with the second embodiment of the present invention, the material used to form the protruding space pads 60 is $Al_2O_3$, $TiO_2$ or inorganic ceramics, but a material having a low reflection rate to improve the contrast is also acceptable. The height of the protruding space pads 60 is about 3 $\mu$m to 15 $\mu$m. The configuration of the space pads 60 is elliptical, but a round or a rectangular configuration is acceptable.

The main different point between the first embodiment and the second embodiment is that the space pads in the second embodiment are arranged in an array, which means that there in no connection between any two space pads 60. The space pads 60 is superimposed on the corresponding wide section 34*a* of the barrier rib 34 of the back plate and across the non-discharge region 42 to superimpose the another wide section 34*a* of the adjacent barrier rib 34 after the front and back plates are adhered to each other. Because the area of the space pads 60 in the non-discharge region 42 is enlarged, the contact stress is decreased after the front and back plates are adhered to each other. This avoids damaging the barrier ribs with the larger contact stress.

Figure 11B:
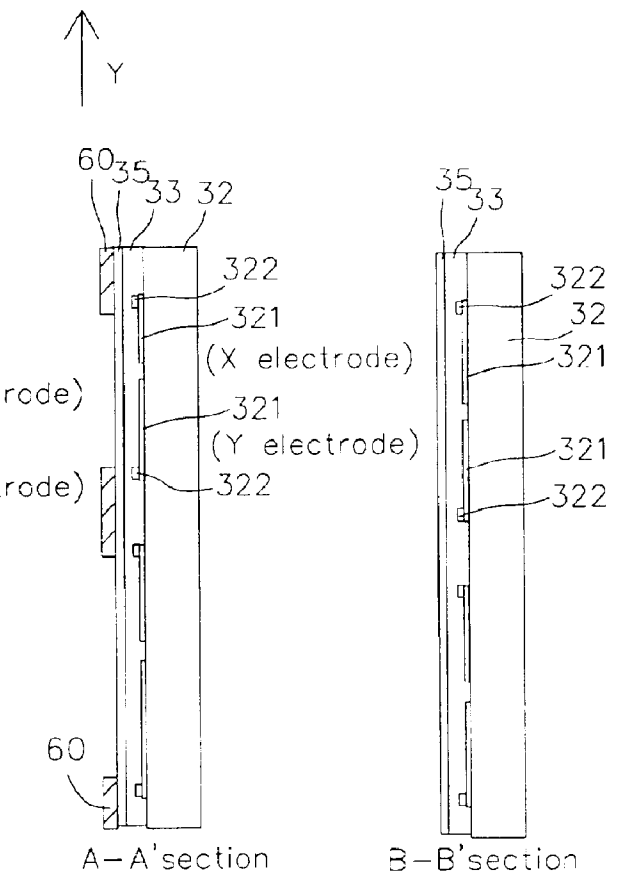
FIG. 11*b* is a schematic, cross-sectional view from the BB' plane shown in the FIG. 10 according to the second embodiment of the present invention.
Figure 11A:
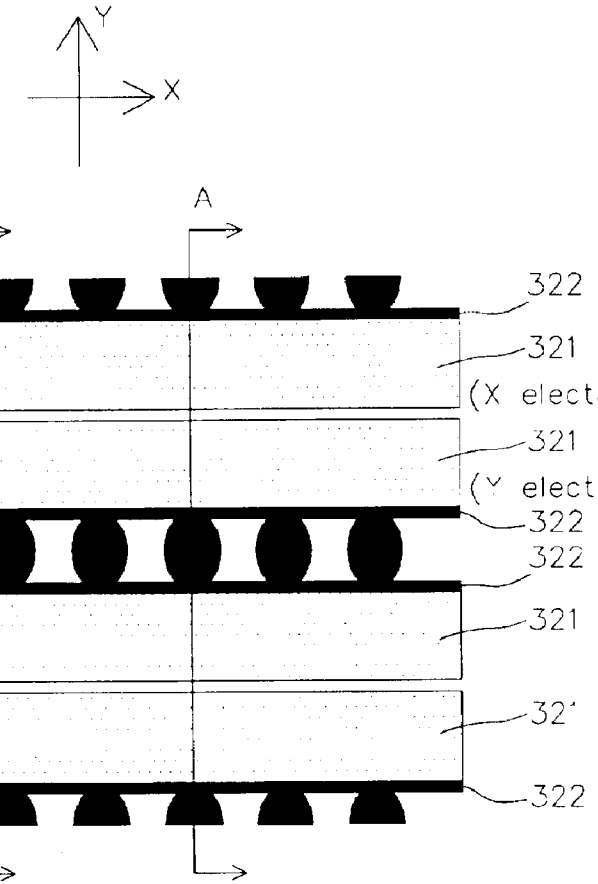
FIG. 11*a* is a schematic, cross-sectional view from the AA' plane shown in the FIG. 10 according to the second embodiment of the present invention.

FIG. 11*a* and FIG. 11*b* respectively show the schematic, cross-sectional view from the AA' plane and BB' plane shown in the FIG. 10 according to the first embodiment of the present invention. First, referring to FIG. 7*a,* a plurality of parallel-arranged transparent electrodes 321, including an X electrode and an Y electrode, are formed on the front plate 32. Each transparent electrode 321 has a bus electrode 322 thereon. A dielectric layer 33 is formed on the front plate 32 to cover the transparent electrodes 321 and bus electrodes 322. A protective layer 35 is formed on the dielectric layer 33. A plurality of protruding space pads 60 are arranged in an array and respectively located between the two adjacent transparent electrodes 321. In other words, the space pads 60 and the transparent electrodes 321, including an X electrode and an Y electrode, are alternatingly formed on the front plate 32. Similarly, please referring to FIG. 11*b,* because there are no space pads 60 on the protective layer 35 in the BB' plane, the space pads 60 are not shown in this figure.

Figure 12:
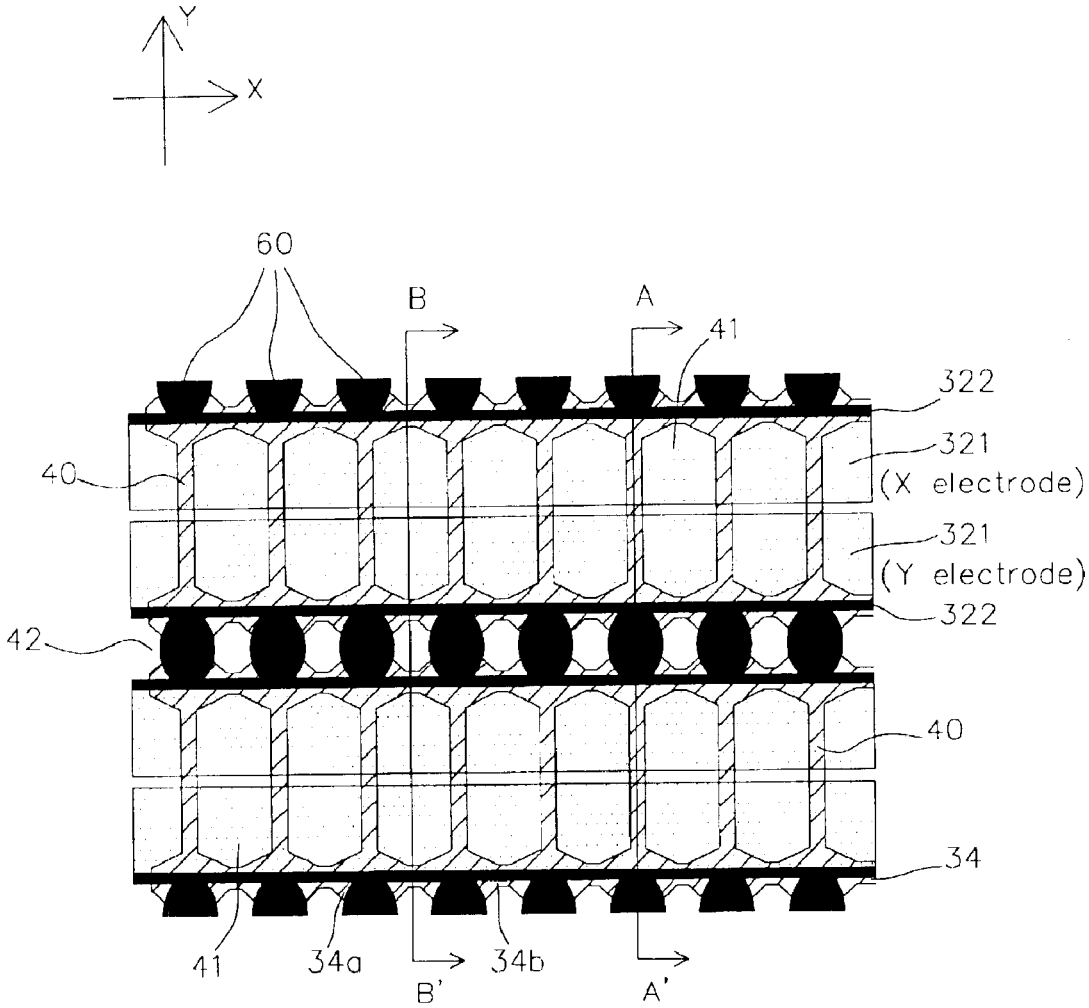
FIG. 12 is a schematic top view after the front and back plates are adhered to each other according to the second embodiment of the present invention.

FIG. 12 shows a schematic top view after the front and back plates are adhered to each other according to the second embodiment of the present invention. A plurality of parallel-arranged transparent electrodes 321, including an X electrode and an Y electrode, is formed on the front plate 32 and the discharge spaces 41 exist therein. The non-discharge region 42 is arranged between the adjacent discharge spaces 41. The structure of each barrier ribs 34 on the back plate 31 is composed of different width, wide section 34*a* and narrow section 34*b.* A plurality of barrier ribs 40 arranged in perpendicular direction (y direction) are used to connect with the wide section 34*a* to divide any two adjacent horizontal barrier ribs 34 into a plurality of discharge spaces 41.

Please still referring to FIG. 12, the protruding space pads 60 are formed by using a low dielectric constant material, such as $Al_2O_3$, $TiO_2$ or inorganic ceramics. The space pads 60 are arranged in an array and formed on the protective layer 35. The layout positions of the protruding space pads 60 are related to the layout position of the non-discharge region 41 on the back plate 31. The height of the protruding space pads 60 is about 3 $\mu$m to 15 $\mu$m. In the horizontal direction (x direction), the adjacent space pads 60 are all separated by a special distance which is equal to the width of the discharge space 41. On the other hand, in the perpendicular direction (y direction), the adjacent space pads 60 are also separated by special distance which is equal to the width of the transparent electrodes 321. When the front and back plates are adhered to each other, as shown in FIG. 12, the space pads 60 are respectively superimposed on the corresponding wide section 34*a* of the barrier rib 34 and across the non-discharge region 42 superimposed with another wide section 34*a* of the adjacent barrier rib 34. Therefore, the contact stress is decreased after the front and back plates are adhered to each other to avoid damaging the barrier ribs with the larger contact stress.

Figure 13B:
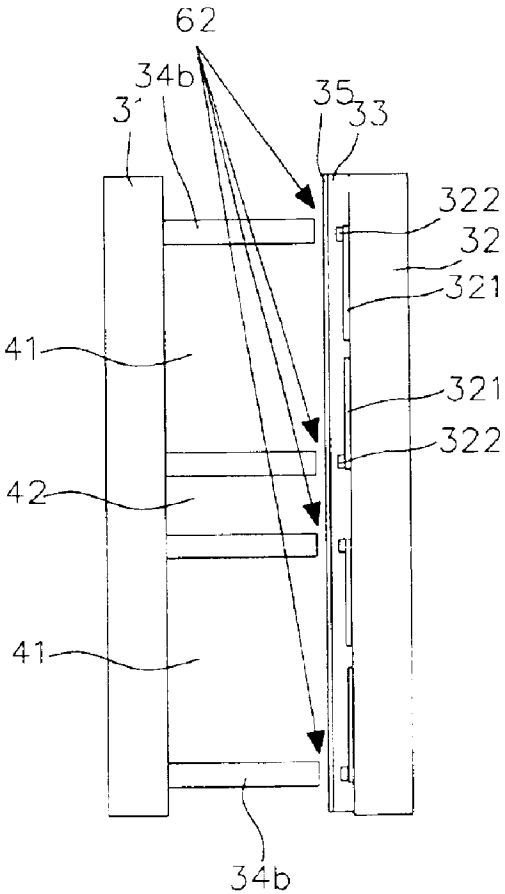
FIG. 13*b* is a schematic, cross-sectional view from the BB' plane shown in the FIG. 12 according to the second embodiment of the present invention.
Figure 13A:
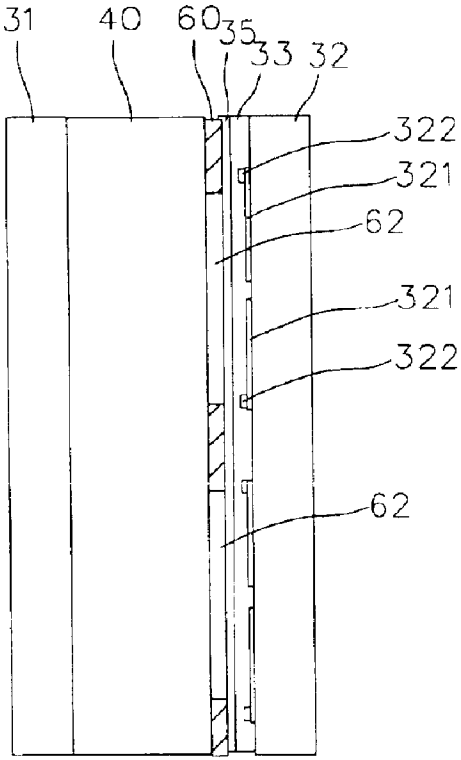
FIG. 13*a* is a schematic, cross-sectional view from the AA' plane shown in the FIG. 12 according to the second embodiment of the present invention.

FIG. 13*a* and FIG. 13*b* respectively show schematic, cross-sectional views from the AA' plane and BB' plane shown in FIG. 12 according to the second embodiment of the present invention. First, referring to FIG. 13*a,* a plurality of parallel-arranged transparent electrodes 321, including an X electrode and an Y electrode, is formed on the front plate 32. Each transparent electrode 321 has a bus electrode 322 thereon. A dielectric layer 33 is formed on the front plate 32 to cover the transparent electrodes 321 and bus electrodes 322. A protective layer 35 is formed on the dielectric layer 33. A plurality of protruding space pads 60 arranged in an array are formed on the protective layer 35. The barrier ribs 40 arranged in perpendicular to the transparent electrodes 321 are formed on the back plate 31. Because the space pads 60 formed on the front plate 32 are arranged in an array, a height difference is formed on the surface of the protective layer 35 after the front plate 32 and back plate 31 are adhered to each other. Some gas channels 62 are formed among the barrier ribs 40 of the back plate 31, the space pads 60 in the front plate 32 and the protective layer 35 after the front and back plates are adhered to each other. These gas channels 62 are helpful for gas purging and refilling processes. On the other hand, in accordance with the design of the space pads 60 in the second embodiment, when the front and back plates are adhered to each other, the space pads 60 align the wide sections 34*a* of the barrier ribs 34. Therefore, the alignment process is easier to perform.

FIG. 13*b* shows the schematic, cross-sectional view from the BB' plane shown in FIG. 12 according to the second embodiment of the present invention. Because no space pads 60 are formed on the front plate 32 in the BB' plane, a flat protective layer 35 is exposed in the BB' plane. Some gas channels 62 are formed between the narrow section 34*b* of the barrier ribs 34 of the back plate 31 and the protective layer 35 after the front and back plates are adhered to each other. In other words, the discharge spaces 41 in the BB' plane are not closed; they may respectively join the non-discharge region 42 through the gas channels 62. Therefore, these gas channels 62 are helpful for gas purging and refilling processes. On the other hand, in accordance with the design of the present invention, the non-discharge region 42 is used to separate the discharge regions 42 in the BB' plane. Therefore, erroneous discharge occurring in the adjacent discharge space 41 is efficiently avoided.

As is described above, the present invention provides a front plate structure. In accordance with the present invention, a protruding space pad structure is formed on the dielectric layer or protective layer. The space pad is used to form the height difference on the surface of the front plate, about 3 $\mu$m to 15 $\mu$m. The height difference forms gas channels between the front plate and the discharge region to improve the performance of the vacuuming and refilling gas steps. In the manufacture of the front plate in the first embodiment, protruding space pad strips formed by the low dielectric constant material (such as $Al_2O_3$, $TiO_2$ or inorganic ceramics) are formed on the protective layer of the front plate. The layout position of the space pad structure on the front plate is related to the layout position of the barrier ribs arranged in the perpendicular direction (y direction) on the back plate. Therefore, this space pad structure is superimposed on the barrier ribs to form an almost closed state in the perpendicular direction after the front and back plates are adhered to each other. The almost closed state in the perpendicular direction may constrict energy in this discharge space as well as gas discharge, and avoid erroneous discharge in the adjacent discharge space; this structure is helpful in utilizing gas discharge energy.

In accordance with the second embodiment, the protruding space pad structure is only formed on the protective layer of the front plate in areas corresponding to the non-discharge region on the back plate. In accordance with this kind of design, this space pad structure not only meets the requirement of gas purging and refilling processes, but also does not require the alignment between the space pad structure and the barrier ribs on the back plate. Therefore, this space pad structure of the second embodiment decreases the alignment requirement when the front and back plates are adhered to each other. In accordance with the space pad structure of the present invention, the space pad area located in the non-discharge region is enlarged. Therefore, the contact stress is decreased after the front and back plates are adhered to each other to avoid damaging the barrier ribs with the larger contact stress.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structure.

What is claimed is:

1. A front plate structure for a plasma display panel formed over a plurality of discharge units, wherein a plurality of barrier ribs having wide sections and narrow sections alternatingly formed in a first direction and a plurality of barrier ribs formed in a second direction comprises said plurality of discharge units in a back plate, and any two adjacent discharge units are separated by a non-discharge region in the second direction, said front plate structure comprising:

a plate;

a plurality of transparent electrodes formed on said plate and arranged in the first direction and parallel to each other;

a dielectric layer formed on said plurality of transparent electrodes;

a protective layer formed on said dielectric layer; and a plurality of space pad strips formed on said protective layer and arranged in the second direction and parallel to each other to form a height difference, said plurality of space pad strips having a plurality of wide portions and narrow portions, each being alternatingly formed in the second direction, wherein each wide portion is superimposed on a corresponding wide section of said barrier rib arranged in the first direction and across the non-discharge region superimposed on another wide section of the adjacent barrier rib arranged in the first direction, each narrow portion is superimposed on a corresponding barrier rib arranged in the second direction, and, in the first direction, any two adjacent wide portions may form a gas channel.

2. The front plate structure according to claim 1, wherein said first direction is perpendicular to said second direction.

3. The front plate structure according to claim 1, wherein the plate is glass.

4. The front plate structure according to claim 1, wherein a configuration of said wide portion of said space pad strips is elliptical.

5. The front plate structure according to claim 1, wherein a configuration of said wide portion of said space pad strips is round.

6. The front plate structure according to claim 1, wherein the configuration of said wide portion of said space pad strips is rectangular.

7. The front plate structure according to claim 1, wherein a material of said space pad strips is Al2O3.

8. The front plate structure according to claim 1, wherein a material of said space pad strips is TiO2.

9. The front plate structure according to claim 1, wherein a material of said space pad strips is inorganic ceramics.

10. The front plate structure according to claim 1, wherein said height difference is between about 3 $\mu$m and 15 $\mu$m.

11. A discharge luminescent structure of a plasma display panel, comprising:

a back plate, whereon a plurality of address electrodes arranged in a second direction and parallel to each other are formed;

a plurality of discharge units, wherein a plurality of barrier ribs having wide section and narrow section are alternatingly formed in the first direction and a plurality of barrier ribs formed in the second direction comprise said plurality of discharge units on said back plate, and any two adjacent discharge units are separated by a non-discharge region in the second direction;

a fluorescent layer on side walls and a bottom of each discharge space; and a front plate formed over said plurality of discharge units, wherein a plurality of transparent electrodes are formed on said front plate and arranged in the first direction and parallel to each other, said transparent electrodes cross said address electrodes over said plurality discharge spaces respectively, a plurality of space pad strips is formed on said front plate, arranged in the second direction and parallel to each other to form a height difference, said plurality of space pad strips has a plurality of wide portions and narrow portions, each being alternatingly formed in the second direction, said each wide portion is superimposed on the corresponding wide section of said barrier rib arranged in first direction and across the non-discharge region to superimpose upon another wide section of the adjacent barrier rib arranged in first direction, said each narrow portion is superimposed on the corresponding barrier rib arranged in second direction, and in the first direction any two adjacent said wide portion form a gas channel.

12. The front plate structure according to claim 11, wherein said first direction is perpendicular to said second direction.

13. The discharge luminescent structure according to claim 11, wherein a configuration of said wide portion of said space pad strips is elliptical.

14. The discharge luminescent structure according to claim 11, wherein the configuration of said wide portion of said space pad strips is round.

15. The discharge luminescent structure according to claim 11, wherein a configuration of said wide portion of said space pad strips is rectangular.

16. The discharge luminescent structure according to claim 11, wherein a material of said space pad strips is Al2O3.

17. The discharge luminescent structure according to claim 11, wherein a material of said space pad strips is TiO2.

18. The discharge luminescent structure according to claim 11, wherein a material of said space pad strips is inorganic ceramics.

19. The discharge luminescent structure according to claim 11, wherein said height difference is between about 3 $\mu$m and 15 $\mu$m.

20. A discharge luminescent structure of a plasma display panel, comprising:

a back plate, whereon a plurality of address electrodes arranged in second direction and parallel to each other are formed;

a plurality of discharge units, wherein a plurality of barrier ribs having a wide section and a narrow section alternatingly formed in the first direction and a plurality of barrier ribs formed in the second direction comprise said plurality of discharge units on said back plate, and any two adjacent plurality of discharge units are separated by a non-discharge region in the second direction;

a fluorescent layer on sidewalls and a bottom of said each discharge space; and a front plate formed over said plurality of discharge units, wherein a plurality of transparent electrodes are formed on said front plate and arranged in the first direction and parallel to each other, said transparent electrodes cross said address electrodes over said plurality discharge spaces respectively, a plurality of space pads is formed on said front plate to form a height difference, each space pad is superimposed on the corresponding wide section of said barrier rib arranged in first direction and across the non-discharge region to be superimposed upon another wide section of the adjacent barrier rib arranged in first direction, and any two adjacent said space pads form a gas channel.

21. The discharge luminescent structure according to claim 20, wherein said first direction is perpendicular to said second direction.

22. The discharge luminescent structure according to claim 20, wherein a configuration of said space pad is elliptical.

23. The discharge luminescent structure according to claim 20, wherein a configuration of said space pad is round.

24. The discharge luminescent structure according to claim 20, wherein a configuration of said space pad is rectangular.

25. The discharge luminescent structure according to claim 20, wherein a material of said space pads is $Al_2O_3$.

26. The discharge luminescent structure according to claim 20, wherein a material of said space pads is $TiO_2$.

27. The discharge luminescent structure according to claim 20, wherein a material of said space pads is inorganic ceramics.

28. The discharge luminescent structure according to claim 20, wherein said height difference is between about 3 $\mu$m and 15 $\mu$m.

* * * * *